US005377994A

United States Patent [19]

Jones

[11] Patent Number: 5,377,994

[45] Date of Patent: Jan. 3, 1995

[54] GAMING TABLE APPARATUS

[75] Inventor: Daniel A. Jones, Las Vegas, Nev.

[73] Assignee: D&D Gaming Patents, Inc., Pompano Beach, Fla.

[21] Appl. No.: 814,712

[22] Filed: Dec. 30, 1991

[51] Int. Cl.[6] ..... A63F 9/00

[52] U.S. Cl. ..... 273/309; 273/148 R

[58] Field of Search ..... 273/1 E, 85 CP, 274, 273/292, 138 A, 309, 148 R; 232/55, 58; 193/DIG. 1, 2 R; 377/7

[56] References Cited

U.S. PATENT DOCUMENTS

| | | | |
|---|---|---|---|
| 1,238,736 | 9/1917 | Barrett | 193/DIG. 1 |
| 4,614,342 | 9/1986 | Takashima | 273/85 CP |
| 4,813,675 | 3/1989 | Greenwood | 273/138 A |
| 4,861,041 | 8/1989 | Jones et al. | 273/292 |
| 5,007,519 | 4/1991 | Mercurio | 194/351 |
| 5,078,405 | 1/1992 | Jones et al. | 273/309 |
| 5,112,060 | 5/1992 | Jones | 273/309 |

*Primary Examiner*—V. Millen
*Assistant Examiner*—William M. Pierce

[57] ABSTRACT

A gaming table is provided with a coin head having a coin-in slot at each of a plurality of player locations. Each coin slot is connected by means of a coin chute to the coin bin formed as part of the chip rack. Each coin that is dropped into the coin slot rolls or slides along the coin chute and into the coin bin during the play of the game. The dealer can reach into the coin bin at any time it is necessary to refill the chip rack with coins for use during the play of the game. The coin chute is preferably configured in a C-shape so that access is available to the coin chute in the event a coin jams in the coin chute.

16 Claims, 3 Drawing Sheets

GAMING TABLE APPARATUS

This invention relates to a gaming table, and more particularly to a gaming table including chutes that connect the coin heads having a coin-in slot with a modified chip rack for recirculating tokens used in the play of the game back to the chip rack for further use.

BACKGROUND OF THE INVENTION

A conventional gaming table used for playing Twenty-One and other similar casino games has a plurality of player locations around the outer periphery of the table and a dealer's location located generally opposite the player locations. From the dealer's location, the dealer of the game effects the operation of the game including dealing of the cards, paying winning wagers and collecting losing wagers.

One important function performed by the dealer is making change for the players. Most casinos would prefer that the players use tokens or chips to make their wagers, rather than currency. The player generally obtains the tokens or chips from the dealer in exchange for currency and all winning wagers are paid in tokens or chips.

A conventional gaming table has a chip rack located adjacent the dealer's location which is filled with the various denomination of tokens or chips that are used in the game. As the game proceeds, losing wagers that are collected are placed in the chip rack and winning wagers are paid using these same chips.

During the course of play, the chip rack may run low and the house performs a "fill" of the chip rack. This entails security and supervisory personnel to obtain the necessary variety of tokens or chips needed and to bring them to the dealer for the filling of the chip rack. In order to maintain accounting requirements and to ensure proper auditing and security, the game must be interrupted while the fill is taking place. The dealer verifies the amount of tokens or chips that are being placed in the chip rack and both the dealer and the supervisory personnel sign receipts acknowledging that a fill has taken place. While casino personnel are generally well versed in the procedures involved in making a fill, the procedure can take as much as five minutes and is most distracting and disruptive to the players.

Because of this inconvenience, casinos would prefer to keep the time disruptions for fills to a minimum and a typical Twenty-One game will only require a fill on the average of every two hours. The size of the chip rack is limited by the size of the table and by security requirements limiting the amount of chips that are exposed in the chip rack due to the fact that the chips have monetary value.

Casino games have been developed that utilize tokensor chips that are placed into a coin head having a coin-in slot in the surface of the gaming table to indicate that the player is participating in the game or a particular feature of the game. For example, U.S. Pat. No. 4,861,041, Jones et al., discloses a method of progressive jackpot gaming that involves a typical casino or cardroom game modified to include a progressive jackpot component. The disclosure of U.S. Pat. No. 4,861,041 is hereby incorporated by reference.

During the play of a Twenty-One game, for example, in addition to his normal wager, a player will have the option of making an additional wager that becomes part of, and makes the player eligible to win, the progressive jackpot. If the player's Twenty-One hand comprises a particular, predetermined arrangement of cards, the player will win all or part of amount showing on the progressive jackpot. This progressive jackpot feature is also adaptable to other casino or cardroom games such as Draw Poker, Stud Poker, Lo-Ball Poker or Caribbean Stud ® Poker.

The apparatus used in this type of game comprises a gaming table, such as those used for Twenty-One or poker, modified with the addition of a token, chip or coin head having a coin-in slot that is electronically connected to a progressive jackpot meter. When a player drops a token, chip or coin into the coin slot in the coin head and it is recognized by a coin detection device, a light is activated at the player's location indicating that he is participating in the progressive jackpot component of the game during that hand At the same time, a signal from the coin detector is sent to the progressive meter to increment the amount shown on the progressive meter. At the conclusion of the play of each hand, the coin detector is reset for the next hand. When a player wins all or part of the progressive jackpot, the amount showing on the progressive jackpot meter is reduced by the amount won by the player.

The token, chip or coin that is placed into the coin slot and passes through the coin detector falls down a conduit and into a bucket placed on the interior of the gaming table. At designated times during the day, casino personnel collect the tokens, chips or coins that have fallen into the bucket and the empty bucket is replaced on the interior of the gaming table.

The players will purchase the tokens, chips or coins that are used in the coin slot from the dealer who maintains his supply of these tokens, chips or coins in the chip rack. However, unlike during the play of the regular game in which tokens or chips are continually cycling into and out of the chip rack as the players win or lose, the tokens, chips or coins used in the coin slots only come out of the chip rack. The wagered tokens, chips or coins placed into the coin slot fall into the buckets on the interior of the gaming table and are not available for recycling back to the player.

Whatever supply of tokens, chips or coins is initially available in the chip rack for use in the coin slots will be quickly exhausted and the casino personnel will be required to effect a "fill" of the chip rack to replenish the supply. Fills will be much more frequent in this type of game causing additional inconvenience to the players and to the casino which must interrupt the game to effect the fill.

It is an object of the present invention to provide an apparatus that allows for the recycling of the tokens, chips or coins that are used in the play of a live casino table game.

It is a feature of the present invention to provide an apparatus that uses a coin chute joining the coin slot in the coin head with the chip rack so that the wagered tokens, chips or coins that are dropped through the coin slot in the surface of a gaming table automatically roll or slide down the coin chute and back into the chip rack.

It is a further feature of the invention to provide a modified chip rack that can receive the wagered tokens, chips or coins fed to the coin slot in the surface of the gaming table.

It is an advantage of the present invention that the need for frequent fills of the chip rack can be minimized in live casino table games that utilize tokens, chips or coins dropped through a coin slot in the surface of the gaming table during the play of the game. The house will experience a savings in personnel time since the need for numerous fills will be eliminated. The house will also experience a savings in connection with the expense of the paperwork processing associated with each fill including internal accounting personnel time and the cost of the fill slips themselves, which must be on a form approved by the gaming authorities for the jurisdiction involved.

It is a further advantage of the present invention that a supply of tokens, chips or coins that are used in the coin slot in the surface of the gaming table is always available to the dealer without the necessity of the casino personnel undertaking the steps necessary to coordinate a "fill" of the chip rack.

SUMMARY OF THE INVENTION

A gaming table is provided with a coin head having a coin-in slot at each of a plurality of player locations. Each coin slot is connected by means of a coin chute to the coin bin formed as part of the chip rack. Each coin that is dropped into the coin slot rolls or slides along the coin chute and into the coin bin during the play of the game. The dealer can reach into the coin bin at any time it is necessary to refill the chip rack with coins for use during the play of the game. The coin chute is preferably configured in a C-shape so that access is available to the coin chute in the event a coin jams in the coin chute.

DETAILED DESCRIPTION OF THE PREFERRED EMBODIMENTS

Figure 1:
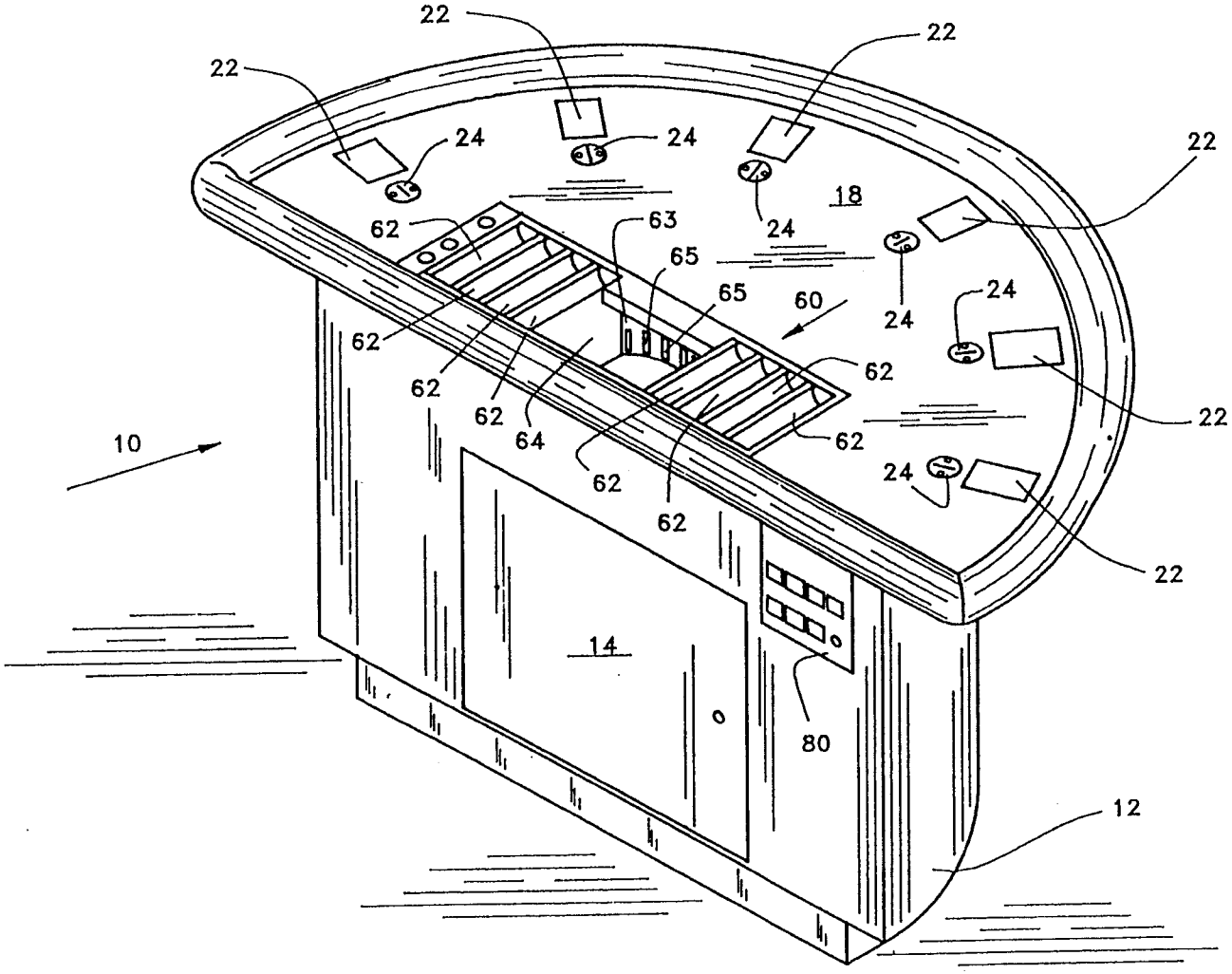
FIG. 1 shows a perspective view of a gaming table embodying the present invention with the interior of the gaming table not shown.

The gaming table modified in accordance with the present invention is shown generally at 10 in FIG. 1. The gaming table 10 includes a conventional gaming table base 12 which is normally hollow on the interior thereof underneath the gaming table top 18. Access to the interior of the gaming table base 12 is by way of a lockable door 14.

Figure 5:
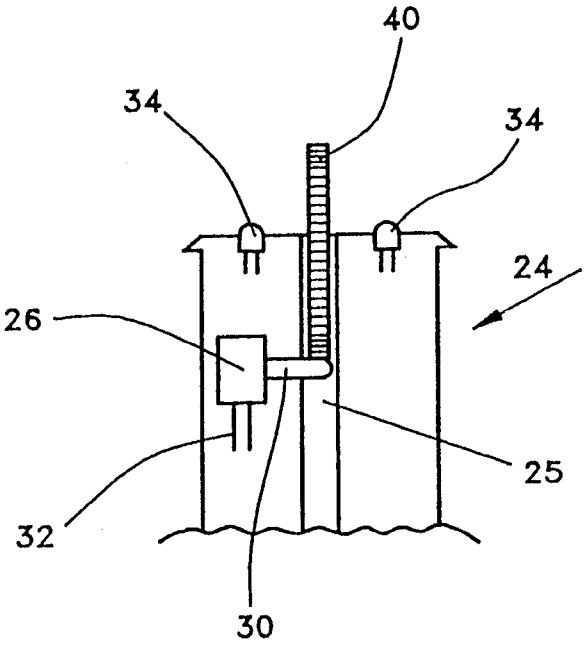
FIG. 5 is a side sectional view of the coin head with a coin slot of the present invention.
Figure 4:
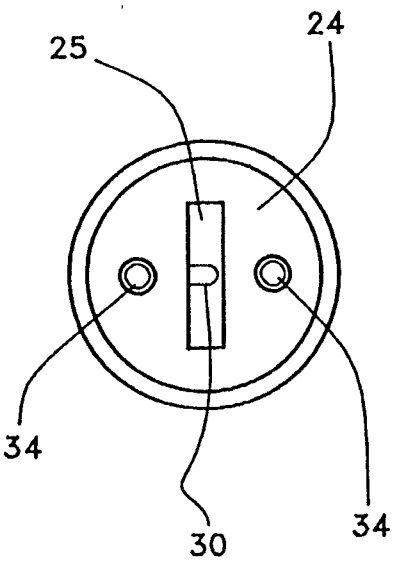
FIG. 4 is a top view of the coin head with a coin slot of the present invention.

The gaming table top 18 includes a plurality of player locations 22 distributed around the periphery of the gaming table 10 in a conventional arrangement. Each player location 22 is provided with an associated coin head 24 having a coin slot 25 (as shown in FIGS. 4 and 5). The coin head 24 and the coin slot 25 are used whenever a game is played that allows or permits the players to make an extra wager during the game so that the extra wager can be added to a progressive jackpot.

Representative of a game that allows or permits the players to make an extra wager during the game so that the extra wager is added to a progressive jackpot is that described in U.S. Pat. No. 4,861,041 to Jones et al.

Positioned immediately below each coin head 24 and disposed adjacent the coin slot 25 is a token or coin detector 26 (see FIGS. 4 and 5). The coin detector 26 comprises a solenoid switch 30 that is disposed in the coin slot 25. When a coin 40 is placed in the coin head 24 by a player, it comes to rest in the coin slot 25 on top of the solenoid switch 30. The presence of the coin 40 is detected by the coin detector 26 and the light bulbs 34 are illuminated to advise both the player and the dealer that the player is participating in the progressive jackpot feature of the game during the play of that hand.

The coin detector 26 is also connected electronically by wires 32 to the control panel 80 mounted on the gaming table 10 and also to the light bulbs 34. At the beginning of the play of the hand, the dealer presses one of the buttons 82 on the control panel 80 which causes the solenoid switch 30 to open allowing the coin 40 to fall into a coin chute 28. The progressive meter (not shown) is also activated to increment the value of the coin to increase the amount of the jackpot as explained in U.S. Pat. No. 4,861,041 to Jones et al.

Figure 2:
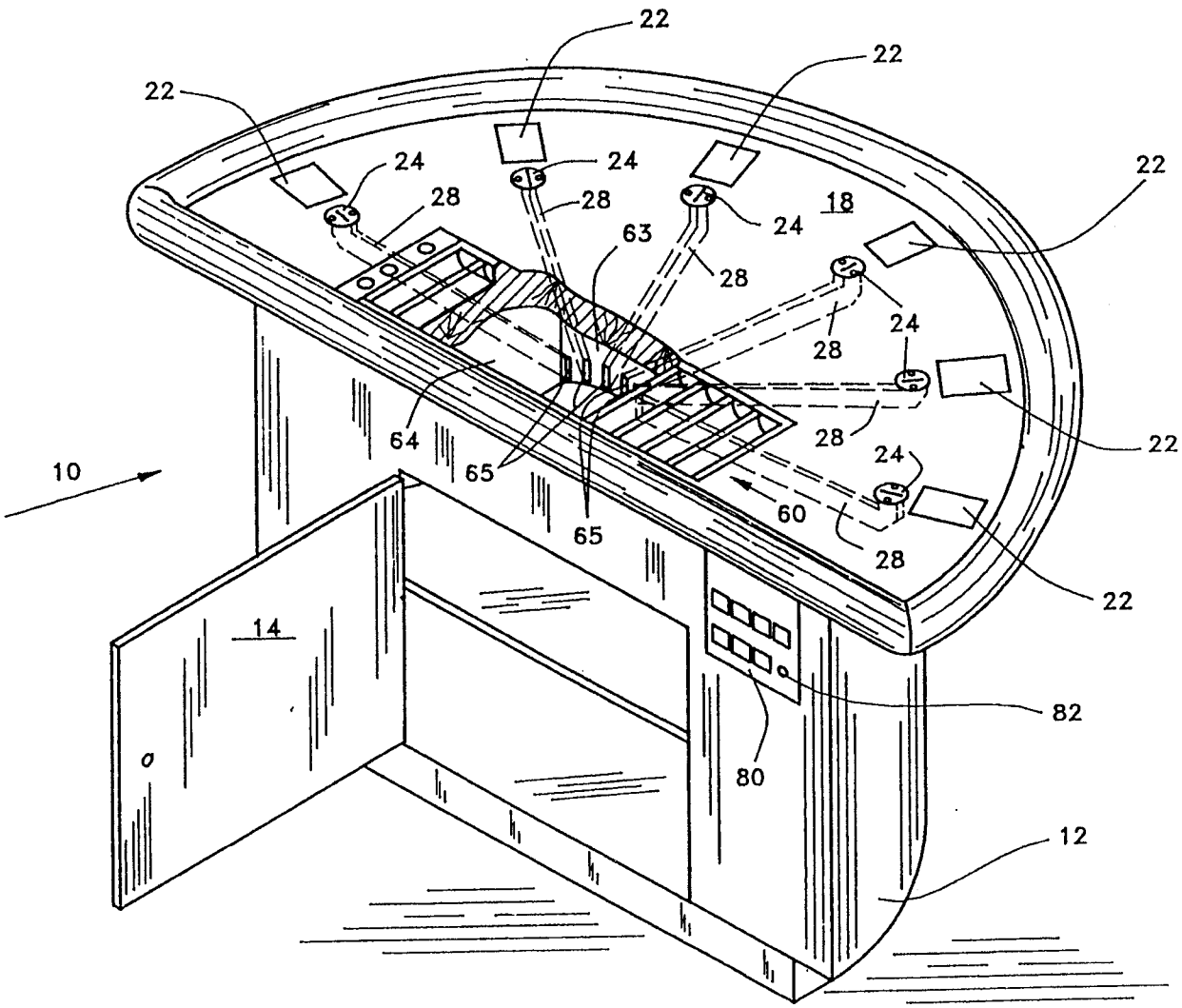
FIG. 2 shows a perspective view of a gaming table embodying the present invention partly in section showing the interior of the gaming table.

As shown in FIG. 2, each coin slot 25 is connected by means of a coin chute 28 with a chip rack 60. The chip rack 60 includes a plurality of chip rows 62 arranged side by side which are accessible to the dealer and from which the money transactions are made that occur during the normal play of the game such as the payouts, collections and changing of currency. Typically, a chip rack 60 has chip rows 62 assigned for the different denominations of tokens or coins that are used in the game.

The chip rack 60 of the present invention has been modified to also include a coin bin 64 at the center of the chip rack 60 which communicates by way of a coin entry slot 65 with each of the coin chutes 28. In the preferred embodiment of the present invention, the interior wall 63 of the coin bin 64 is curved so that each coin chute opens into the interior of the coin bin at an angle of approximately 90°. This minimizes the possibility that a coin will jam at the coin entry slot 65 into the coin bin. Whenever the chip rack 60 begins to run low on the tokens or coins that are used in the coin head 24, the dealer can obtain a resupply of tokens or coins from the chip bin 64.

Figure 3:
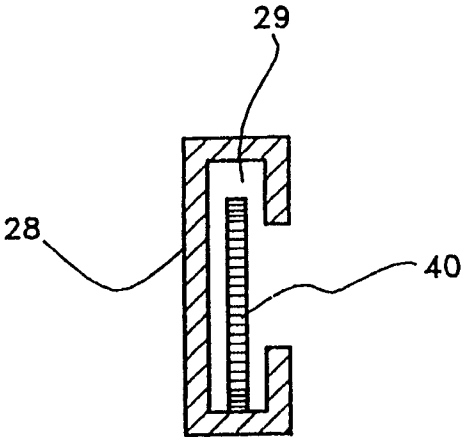
FIG. 3 shows a cross-sectional view of the coin chute used in the present invention.

As shown in FIG. 3, in the preferred embodiment of the present invention, the coin chute 28 is configured in a C-shape so that access is available to the interior of the coin chute to remove any coins 25 that may be jammed in the coin chute 28. It is also preferred that the interior width 29 of the coin chute 28 be approximately three times the width of the coin 25 so that coin jamming is kept to a minimum.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A gaming table apparatus comprising:

a) a gaming table including at least one player location provided on the surface of the table, b) each player location including a coin head having a coin slot therein, (c) a coin bin mounted in the gaming table, the coin bin comprising a generally hollow body having walls extending below the surface of the gaming table, and (d) a coin chute extending from the coin slot to the coin bin whereby coins placed in the coin slot roll down the coin chute and into the coin bin for access by a dealer whenever the coin supply for the gaming table runs low.

2. The gaming table apparatus of claim 1 further including a plurality of player locations arranged around a periphery of the surface of the gaming table, each player location having a coin head with a coin slot therein, and a coin chute extending from each coin slot to the coin bin.

3. The gaming table apparatus of claim 1 further including a coin detector mounted in the coin head adjacent to the coin slot, the coin detector including a solenoid switch upon which the coin comes to rest when the coin is placed in the coin slot.

4. The gaming table apparatus of claim 3 further including a button mounted on the gaming table and connected to the solenoid switch whereby when the button is activated, the solenoid switch opens to allow the coin to fall into the coin chute and to roll into the coin bin.

5. The gaming table apparatus of claim 3 further including at least one light bulb mounted in the coin head, the light bulb being activated when the coin detector senses the presence of a coin in the coin slot.

6. The gaming table apparatus of claim 1 wherein the coin chute has a C-shaped cross-section so that access is available to the coin chute in the event of a coin jam.

7. The gaming table apparatus of claim 1 wherein one of the walls of the coin bin is a curved wall section with at least one coin entry slot provided therein, the coin chute connecting to the coin bin at the location of the coin entry slot at an angle of approximately 90° relative to the curvature of the wall section.

8. The gaming table apparatus of claim 2 wherein one of the walls of the coin bin is a curved wall section with a plurality of coin entry slots provided therein, each coin chute associated with a coin entry slot and connecting to the coin bin at the location of the coin entry slot at an angle of approximately 90° relative to the curvature of the wall section.

9. A gaming table apparatus comprising:

a) a gaming table including at least one player location provided on the surface of the table, b) each player location including a coin head having a coin slot therein, (c) a chip rack mounted in the surface of the gaming table, the chip rack including a coin bin, the coin bin comprising a generally hollow body having walls extending below the surface of the gaming table, and (d) a coin chute extending from the coin slot to the coin bin whereby coins placed in the coin slot roll down the coin chute and into the coin bin for access by a dealer whenever the coin supply for the gaming table runs low.

10. The gaming table apparatus of claim 9 further including a plurality of player locations arranged around a periphery of the surface of the gaming table, each player location having a coin head with a coin slot therein, and a coin chute extending from each coin slot to the coin bin.

11. The gaming table apparatus of claim 9 further including a coin detector mounted in the coin head adjacent to the coin slot, the coin detector including a solenoid switch upon which the coin comes to rest when the coin is placed in the coin slot.

12. The gaming table apparatus of claim 11 further including a button mounted on the gaming table and connected to the solenoid switch whereby when the button is activated, the solenoid switch opens to allow the coin to fall into the coin chute and to roll into the coin bin.

13. The gaming table apparatus of claim 11 further including at least one light bulb mounted in the coin head, the light bulb being activated when the coin detector senses the presence of a coin in the coin slot.

14. The gaming table apparatus of claim 9 wherein the coin chute has a C-shaped cross-section so that access is available to the coin chute in the event of a coin jam.

15. The gaming table apparatus of claim 9 wherein one of the walls of the coin bin is a curved wall section with at least one coin entry slot provided therein, the coin chute connecting to the coin bin at the location of the coin entry slot at an angle of approximately 90° relative to the curvature of the wall section.

16. The gaming table apparatus of claim 10 wherein one of the walls of the coin bin is a curved wall section with a plurality of coin entry slots provided therein, each coin chute associated with a coin entry slot and connecting to the coin bin at the location of the coin entry slot at an angle of approximately 90° relative to the curvature of the wall section.

* * * * *